United States Patent [19]

Oyagi et al.

[11] Patent Number: 4,779,091

[45] Date of Patent: Oct. 18, 1988

[54] RADIO PAGER RECEIVER CAPABLE OF INFORMING WHETHER OR NOT MEMORY BACKUP IS CORRECT

[75] Inventors: Takashi Oyagi; Toshihiro Mori, both of Tokyo, Japan

[73] Assignee: NEC Corporation, Tokyo, Japan

[21] Appl. No.: 8,193

[22] Filed: Jan. 29, 1987

[30] Foreign Application Priority Data

Jan. 31, 1986 [JP] Japan ..... 61-17725
Jan. 31, 1986 [JP] Japan ..... 61-11705[U]

[51] Int. Cl.[4] ..... G08B 5/22

[52] U.S. Cl. ..... 340/825.44; 340/311.1; 455/343

[58] Field of Search ..... 340/825.44–825.48, 340/311.1, 715; 455/31, 38, 343, 186; 379/56, 57; 371/66, 21; 365/226, 228, 229

[56] References Cited

U.S. PATENT DOCUMENTS

| | | | |
|---|---|---|---|
| 4,232,377 | 11/1980 | Tallman | 365/229 |
| 4,368,532 | 1/1983 | Imazeki et al. | 371/21 |
| 4,369,443 | 1/1983 | Giallanza et al. | 340/825.44 |
| 4,646,307 | 2/1987 | Nishimura | 371/66 |
| 4,658,352 | 4/1987 | Nagasawa | 371/66 |
| 4,682,148 | 7/1987 | Ichikawa et al. | 340/825.44 |

FOREIGN PATENT DOCUMENTS

| | | | |
|---|---|---|---|
| 0136677 | 4/1985 | European Pat. Off. | 340/825.44 |
| 2149164 | 6/1985 | United Kingdom | 340/825.44 |

OTHER PUBLICATIONS

Desautels et al., "Battery Backup Failure Detection", IBM Technical Disclosure Bulletin, vol. 26, No. 6, Nov. 1983.

*Primary Examiner*—John W. Caldwell, Sr.
*Assistant Examiner*—Edwin C. Holloway, III
*Attorney, Agent, or Firm*—Sughrue, Mion, Zinn, Macpeak and Seas

[57] ABSTRACT

A radio pager receiver has a memory with a message area, and an additional area and a message processor for processing a message signal into messages and to store the messages in the message area. A specific datum is written (S6) in the additional area by the message processor. Although the message processor and the memory are activated by main electric power of a power supply circuit, only the memory is backed up by backup electric power of a backup power source. When the memory and the message processor are activated after once deactivated, the message processor judges (S2) whether or not the specific datum is correctly kept. The message processor controls display (S3 and S4) of a result of judgement. In the message area and the additional area, entries may be erased (S8) by the message processor when the specific datum is not correctly kept. When the specific datum is correctly kept, the message processor may make a display unit display each of the messages together with an announcement which indicates whether or not the each of the messages is subjected to a backup operation by the backup electric power.

4 Claims, 7 Drawing Sheets

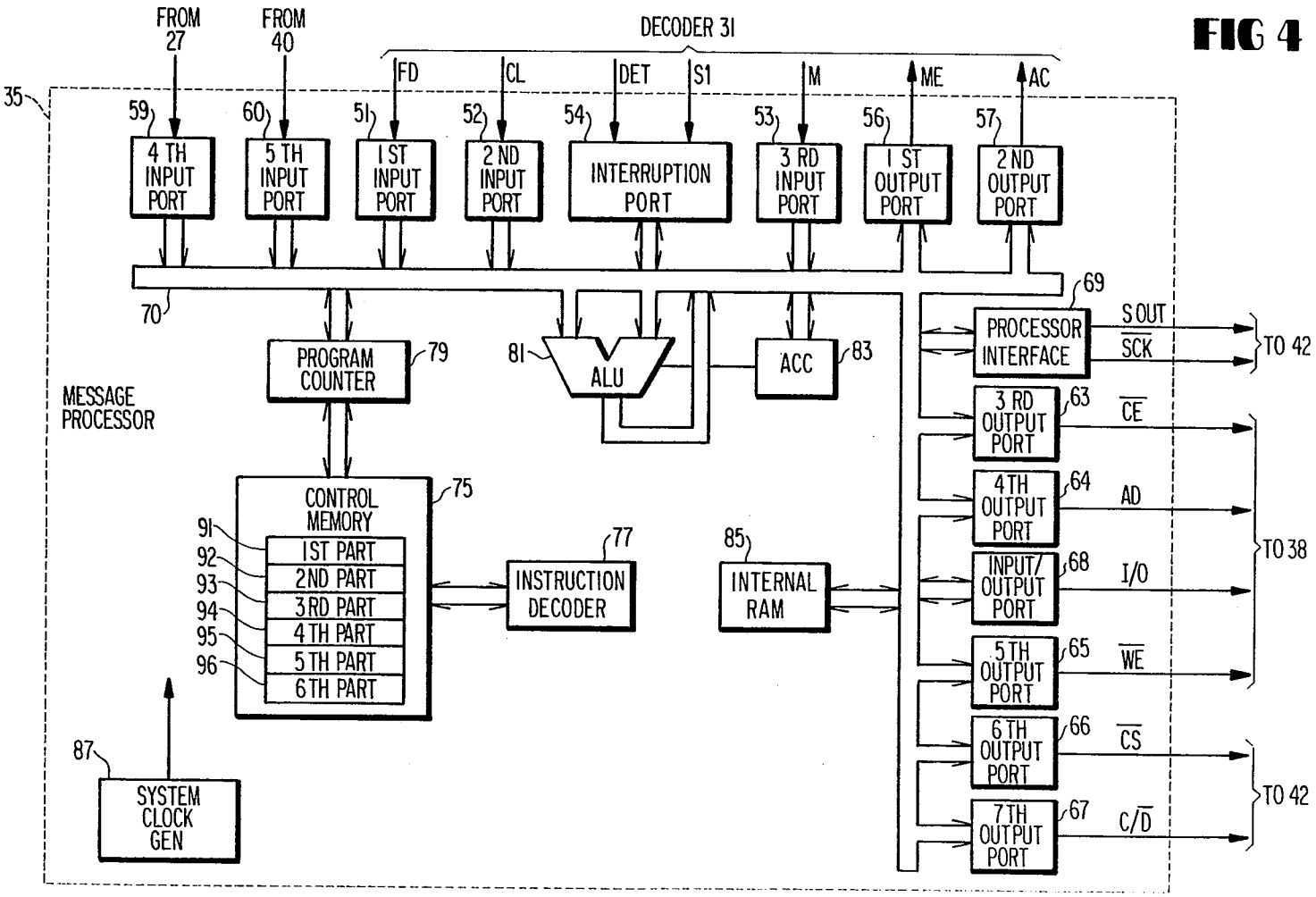
FIG 4
DECODER 31
FD
CL
DET
S1
M
ME
AC
FROM 27
FROM 40
4 TH INPUT PORT
5 TH INPUT PORT
1 ST INPUT PORT
2 ND INPUT PORT
INTERRUPTION PORT
3 RD INPUT PORT
1 ST OUTPUT PORT
2 ND OUTPUT PORT
59
60
51
52
54
53
56
57
70
PROGRAM COUNTER
79
ALU
81
ACC
83
PROCESSOR INTERFACE
69
S OUT
SCK
TO 42
CE
AD
I/O
WE
CS
C/D
TO 38
3 RD OUTPUT PORT
4 TH OUTPUT PORT
INPUT/ OUTPUT PORT
5 TH OUTPUT PORT
6 TH OUTPUT PORT
7 TH OUTPUT PORT
63
64
68
65
66
67
INTERNAL RAM
85
INSTRUCTION DECODER
77
CONTROL MEMORY
75
1ST PART
2ND PART
3RD PART
4 TH PART
5 TH PART
6 TH PART
91
92
93
94
95
96
SYSTEM CLOCK GEN
87
MESSAGE PROCESSOR
35

RADIO PAGER RECEIVER CAPABLE OF INFORMING WHETHER OR NOT MEMORY BACKUP IS CORRECT

BACKGROUND OF THE INVENTION

This invention relates to a radio pager receiver that can receive a message signal carrying messages and destined to the pager receiver.

A recent technical development has brought about a radio pager receiver which can provide not only an indication of a call received by the pager receiver but also visual display of messages on a display unit. Such a radio pager receiver comprises a memory having a message area for storing the messages. A memory capacity of the memory tends to increase to satisfy a recent demand.

The messages stored in the message area are erased by disconnection of main electric power from a power supply circuit comprising a main battery. The disconnection occurs, for example, when the power supply circuit is deenergized by a switch to carry out exchange of the main battery.

In order to prevent such erasure of the messages stored in the memory, a memory backup method is generally used wherein the memory is backed up by backup electric power from a backup power source. The backup power source is, for example, a backup battery, a capacitor of a large capacitance for accumulating the main electric power. When the power supply circuit is deenergized by the switch, the backup power source delivers the backup electric power to the memory.

In Japanese Unexamined Utility Model Prepublication or Kōkai No. Syō 60-59650, namely, 59650/1985, a conventional radio pager receiver of the type described is disclosed by the present applicants and one other person. The conventional pager receiver is also disclosed in U.S. patent application Ser. No. 655,287 filed Sept. 28, 1984 by Toshihiro Mori et al for assignment to the instant assignee, European Patent Application No. 84111639.5, Canadian Patent Application No. 464,273 and Australian Patent Application No. 33616/1984.

In the conventional radio pager receiver, a memory has a file administration information area for storing file administration information in addition to the message storing area. The file administration information is for use in administrating the messages stored in the message area. Specifically, the file administration information comprises file information indicative of storage addresses of the messages stored in the message area and reception order information indicative of reception order of the messages stored in the message area. The memory is backed up by backup electric power from a backup power source when a power supply circuit is deenergized by a switch in the manner described above.

It is to be noted here that the messages and the file administration information are not always correctly kept in the memory when the power supply circuit is again energized after once deenergized. The memory backup may not be correctly executed, for example, when the backup power of the backup power source has been reduced. However, the conventional radio pager receiver is incapable of informing whether or not the memory backup is correctly executed. This is because the pager receiver is incapable of judging whether or not the messages and the file administration information are correctly kept in the memory when the power supply circuit is again energized. Such judgement cannot be made with reference to only the file administration information which is related to the messages and which is stored in the memory.

Likewise, the conventional pager receiver is incapable of judging whether or not each of the messages stored in the memory is subjected to a backup operation by the backup electric power when the power supply circuit is energized. In other words, it is impossible to judge whether or not the each of the messages stored in the memory is newly received and stored in the memory without being subjected to the backup operation. It is therefore impossible to display the each of the messages stored in the memory together with an announcement indicating whether or not the each of the messages is subjected to the backup operation.

SUMMARY OF THE INVENTION

It is therefore a general object of this invention to provide a radio pager receiver which is capable of informing whether or not memory backup is correctly executed.

It is a specific object of this invention to provide a radio pager receiver of the type described, which is capable of erasing all data stored in a memory in response to an instructing operation of a possessor of the receiver after the receiver informs that the memory backup is not correctly executed.

It is a subordinate object of this invention to provide a radio pager receiver of the type described, which can display messages stored in the memory together with an announcement indicating whether or not each of the messages is subjected to backup operation.

Other objects of this invention will become clear as the description proceeds.

A radio pager receiver to which this invention is applicable is for receiving a message signal carrying messages and destined to the pager receiver. The pager receiver is for use in combination with a power supply circuit for generating main electric power when energized by a switch, and a backup power source for backup electric power. The pager receiver comprises a memory backed up by the backup electric power, activated by the main electric power, and having a message area and an additional area, and processing means activated by the main electric power to process the message signal into the messages and to store the messages in the message area. According to this invention, the processing means comprises writing means for writing a specific datum in the additional area, judging means for judging whether or not the specific datum is correctly kept in the additional area when the memory and the processing means are activated after once deactivated, the judging means thereby producing a result signal representative of a result of judgement, and informing means responsive to the result signal for informing the result.

According to an aspect of this invention, the radio pager receiver further comprises an additional switch coupled to the informing means for producing an erasure mode signal after the informing means informs the result of judgement indicating that the specific datum is not correctly kept in the additional area. The processing means further comprises erasing means activated by the main electric power and responsive to the erasure mode signal for erasing the message and the specific datum from the message area and the additional area.

According to another aspect of this invention, the additional area has a first partial area for the specific datum and a second partial area. The processing means further comprises flag writing means responsive to the result signal and activated by the main electric power to write a flag in the second partial area for each message stored in the message area and subjected to a backup operation by the backup electric power when the result of judgement indicates that the specific datum is correctly kept in the first partial area.

The radio pager receiver may further comprise a display unit coupled to the processing means for displaying the messages stored in the message area. The processing means further comprises control means coupled to the display unit and the second partial area and activated by the main electric power for controlling the display unit to make the display unit display each of the messages together with an announcement indicating whether or not the each of the messages is subjected to the backup operation with reference to the flag stored in the second partial area for the each of the messages.

BRIEF DESCRIPTION OF THE DRAWING

FIG. 4 is a block diagram of a message processor for use in the pager receiver illustrated in FIG. 1;

DESCRIPTION OF THE PREFERRED EMBODIMENT

Figure 1:
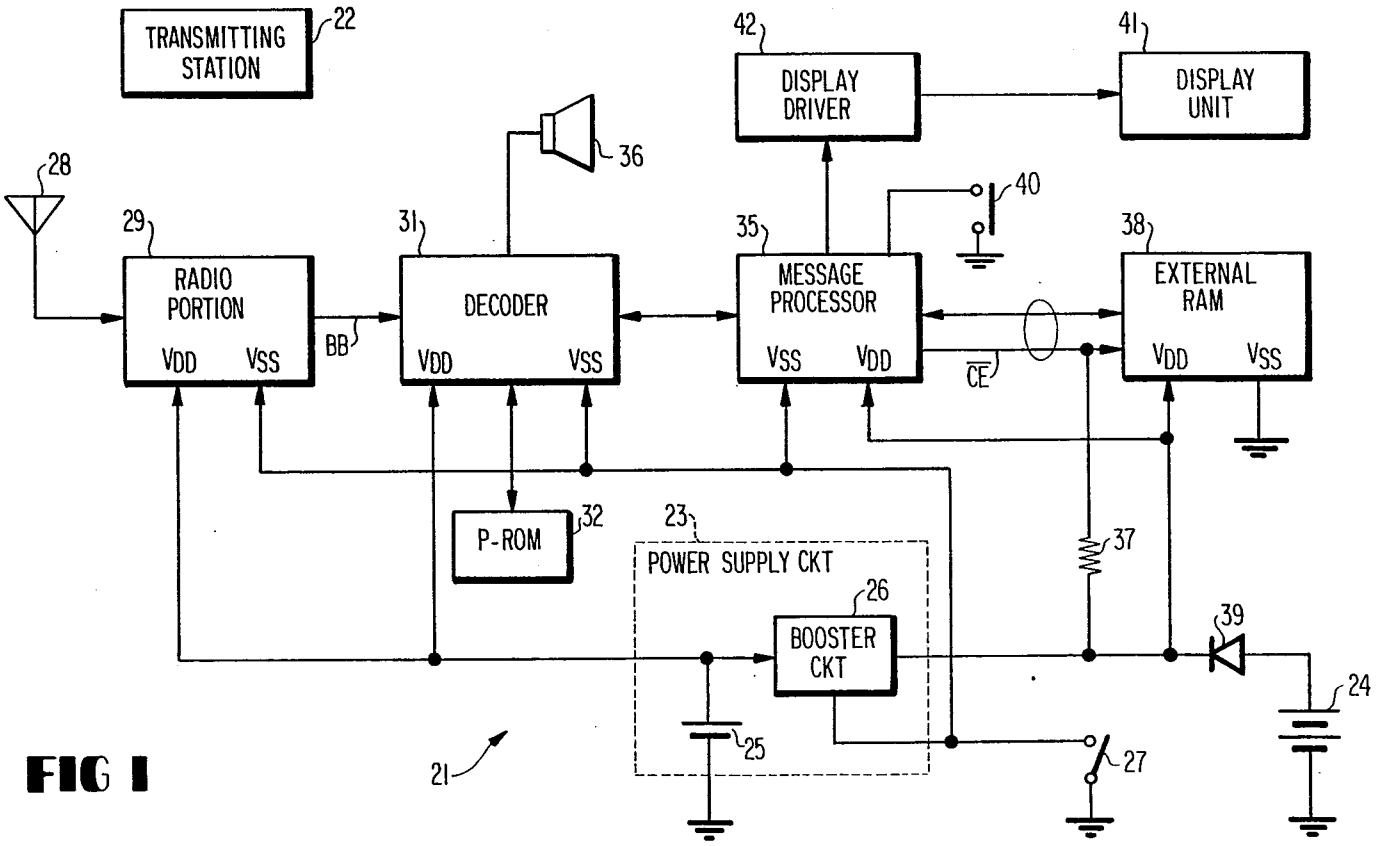
FIG. 1 shows in blocks a radio pager receiver according to a preferred embodiment of this invention together with a transmitting station.
Figure 2:
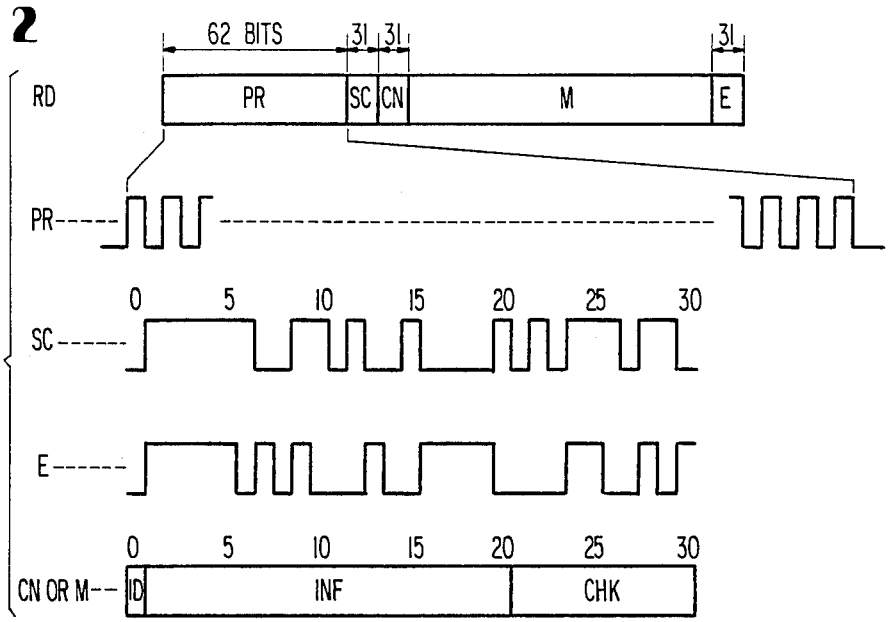
FIG. 2 is a time chart for use in describing a radio call signal received by the pager receiver illustrated in FIG. 1.

Referring to FIG. 1, a radio pager receiver 21 according to a preferred embodiment of this invention is operable in response to a radio call signal which is transmitted from a transmitting station 22. As illustrated in FIG. 2, the radio call signal is indicated at RD along a top line. The radio call signal RD comprises a preamble signal PR of 62 bits, a frame synchronization signal SC of 31 bits, a call number signal CN of 31 bits, a message signal M, and an end signal E of 31 bits, which are successively arranged to form a frame. The preamble signal PR is specified by a repetition of pulses equal in number to 62, as shown along a second line labelled PR. The frame synchronization signal SC has a fixed pattern of 31 bits, as illustrated along a third line labelled SC. Likewise, the end signal E has another fixed pattern of 31 bits different from the fixed pattern of the frame synchronization signal SC, as shown along a fourth line labelled E. Each of the frame synchronization signal SC and the end signal E is formed by a BCH (Bose-Chaudhuri-Hocquenghem) code of (31, 21) which is well known in the art.

In FIG. 2, the call number signal CN consists of the BCH code of (31, 21) like the frame synchronization signal SC and the, end signal E. As depicted in a bottom line labelled CN or M, the call number signal CN comprises an identification area ID of a single bit, an information area INF of 20 bits, and a check bit area CHK of 10 bits. The call number signal CN is specified by a logic "0" level at the identification area ID and carries, in the information area INF, a call number which is assigned to each pager receiver. The message signal M is similar to the call number signal CN, as shown along the bottom line. More particularly, the message signal M consists of the BCH code of (31, 21) and is specified by a logic "1" level at the identification area ID. A message may be formed by a standard code of ISO (International Organization for Standardization) of 7 bits and is located in the information area INF.

As will be understood from the top line of FIG. 2, a plurality of message signals may be arranged following the call number signal CN.

In FIG. 1, the radio pager receiver 21 is for use in combination with a power supply circuit 23 and a backup battery 24 which is operable as a backup power source for backup electric power. The power supply circuit 23 comprises a main battery 25 of a battery voltage and a booster circuit 26 which is connected to the main battery 25 and which is grounded through a receiver switch 27. The battery voltage is used to supply electric power to the booster circuit 26 and other parts of the pager receiver 21. This electric power will herein be called a battery electric power for discrimination from the backup electric power and the like. When the switch 27 is put into an on state, the booster circuit 26 is energized. The booster circuit 26 is deenergized when the switch 27 is put into an off state. The booster circuit 26 boosts the battery voltage into a boosted voltage defining a main electric power when energized. The booster circuit 26 has a boosted voltage terminal to which the boosted voltage is provided. Thus, the power supply circuit 23 generates the main electric power when energized by the switch 27.

The radio call signal is picked up by an antenna 28 and supplied to a radio portion 29 having first and second power supply terminals $V_{DD}$ and $V_{SS}$. The first power supply terminal $V_{DD}$ is connected to the main battery 25 while the second power supply terminal $V_{SS}$ is grounded through the switch 27. Therefore, the battery electric power from the main battery 25 is supplied to the radio portion 29 when the switch 27 is put into the on state. As a result, the radio portion 29 is activated by the battery electric power. The radio portion 29, when activated, converts the radio call signal into a baseband signal BB carrying the preamble signal PR, the frame synchronization signal SC, the call number signal CN, the message signal M, and the end signal E, which are all illustrated in FIG. 2. The baseband signal BB is supplied to a decoder 31 as a succession of digital signals.

The decoder 31 has a first power supply terminal $V_{DD}$ (indicated by the same reference symbol) connected to the main battery 25 and a second power supply terminal $V_{SS}$ grounded through the switch 27 like the radio portion 29. When the switch 27 is put into the on state, the decoder 31 is activated by the battery electric power from the main battery 25. When the decoder 31 is activated by the battery electric power, the decoder 31 decodes the baseband signal BB into the preamble signal PR, the frame synchronization signal SC, the call number signal CN, and the end signal E.

More specifically, the decoder 31 establishes bit synchronization with reference to the preamble pattern PR consisting of repetition of logic "1" and "0" pulses. Thereafter, the decoder 31 detects a frame synchronization signal SC in order to establish frame synchronization.

The decoder 31 cooperates with a P-ROM (programmable read-only memory) 32 so as to detect the call number signal CN assigned to the pager receiver 21. More particularly, the P-ROM 32 stores a directory number signal of 31 bits indicative of a directory number assigned to the pager receiver 21.

When the frame synchronization is established by detecting the frame synchronization signal SC, the decoder 31 starts to read in the directory number signal from the P-ROM 32 and compares the call number signal CN with the directory number signal bit by bit to produce a coincidence pulse on detection of coincidence between bits of the call number and directory number signals. The coincidence pulse is sent to a message processor 35 which is for processing the message signal M.

The decoder 31 sends a tone signal to a loudspeaker 36 to make the loudspeaker 36 generate a call tone indicative of a call for the pager receiver when the decoder 31 decodes the stop signal E after the coincidence pulse is delivered to the message processor 35.

The message processor 35 has a first power supply terminal $V_{DD}$ connected to the boosted voltage terminal of the booster circuit 26 and a second power supply terminal $V_{SS}$ grounded through the switch 27. It is to be noted that the first power supply terminal of the message processor 35 is indicated also by the reference symbol $V_{DD}$. This first power supply terminal $V_{DD}$ is, however, supplied with the boosted voltage rather than the battery voltage. When the switch 27 is put into the on state, the main electric power is supplied from the booster circuit 26 to the message processor 35. As a result, the message processor 35 is activated by the main electric power. The message processor 35 is deactivated when the switch 27 is put into the off state.

As will later be described more in detail, the message processor 35 processes the message signal M into messages in response to the coincidence pulse provided that the message processor 35 is activated by the main electric power. The message processor 35 is connected to a chip enable line $\overline{CE}$ which is connected to the boosted voltage terminal through a resistor 37. The message processor 35 is moreover connected to an external RAM (random access memory) 38 through an input/output bus line and stores the messages in the external RAM 38 by giving a low level to the chip enable line $\overline{CE}$.

The external RAM 38 has a first power supply terminal $V_{DD}$ (designated again by the same reference symbol) and a second power supply terminal $V_{SS}$ which is directly grounded. The first power supply terminal $V_{DD}$ is connected to the backup battery 24 through a diode 39. More particularly, the diode 39 has an anode connected to the backup battery 24 and a cathode connected to the first power supply terminal $V_{DD}$ and to the boosted voltage terminal of the booster circuit 26. With this structure, the external RAM 38 is activated by the main electric power when the switch 27 is put into the on state. When the switch 27 is put into the off state, the external RAM 38 is backed up by the backup electric power from the backup battery 24. Operation of the external RAM 38 will presently be described.

The message processor 35 cooperates with a multifunctional switch 40. If the switch 40 is put into the on state during the call tone is generated, the message processor 35 makes the decoder 31 stop sending the tone signal to the loudspeaker 36 to make the loudspeaker 36 stop generating the call tone. Other functions of the switch 40 will become clear as the description proceeds.

The message processor 35 is connected to a display unit 41 through a display driver 42.

When the receiver switch 27 is put into the on state, the radio portion 29 and the decoder 31 are activated by the battery electric power. On the other hand, the message processor 35 and the external RAM 38 are activated by the main electric power as described above. When the receiver switch 27 is put into the off state, the external RAM 38 is backed up by the backup electric power while the radio portion 29, the decoder 31, and the message processor 35 are deactivated as mentioned above. Although the message processor 35 is connected to the backup battery 24 through the diode 39, the message processor 35 is deactivated. This is because the receiver switch 27 is put into the off state.

Figure 3:
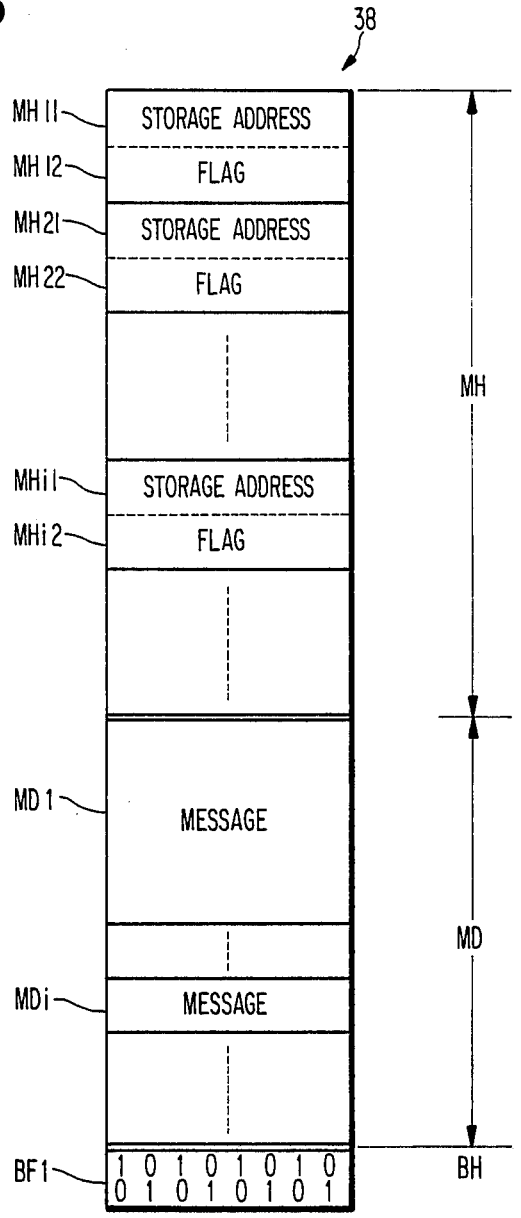
FIG. 3 is a diagram for use in describing operation of an external RAM which is preferably used in the pager receiver illustrated in FIG. 1.

Referring to FIG. 3, the external RAM 38 has a message area MD for storing the messages MD1, . . . , MDi, and so forth from the message processor 35 and an additional area, where i represents a positive integer. The additional area has a first and a second partial area. The first partial area is used as a specific datum area BF. The second partial area serves as a file administration information area MH.

The specific datum area BF is for storing a specific datum BF1 for use in judging whether all data stored in the external RAM 38 are correctly kept in the RAM 38 when the power supply circuit is once deenergized and then again energized. The specific datum BF1 is, for example, a datum of two bytes consisting of "10101010" and "01010101" wherein each digit of one of the two bytes has one of logic "1" and "0" levels when a corresponding digit of another one of the two bytes has another one of the logic "1" and "0" levels.

As an alternative, it is possible to use the specific datum FB1 of one byte. It is, however, necessary in this event that a one-byte datum "00000000" would result when the specific datum BF1 of one byte is added to all data stored in the message area MD and the file administration information area MH. It is furthermore necessary to renew the specific datum BF1 of one byte so as to always provide the one-byte datum "00000000" whenever data stored in the message area MD and the file administration information area MH are renewed.

The file administration information area MH is for storing file administration information which is for use in administrating the messages stored in the message area MD. The file administration information comprises a storage address of each message stored in the message area MD and a flag indicating that each message stored in the message area MD is subjected to a backup operation by the backup electric power. The file administration information area MH has a storage address area for storing the storage addresses MH11, MH21, . . . , MHi1, and so on of the messages MD1, . . . , MDi, and others stored in the message area MD and a flag area for storing the flags MH12, MH22, . . . , MHi2, and so forth indicating that the messages MD1, . . . , MDi, and others stored in the message area MD are subjected to the backup operation. More specifically, the storage address MHi1 and the flag MHi2 are for the message MDi.

Referring to FIG. 4 afresh and FIG. 1 again, the message processor 35 will be described in detail. In FIG. 4, the message processor 35 may be of a single semiconductor chip and comprises first through third input ports 51, 52, and 53 and an interruption port 54, which are all coupled to the decoder 31 (FIG. 1). The first through third input ports 51 to 53 are supplied with a particular pulse sequence FD, a clock pulse sequence CL, and the message signal M. The clock pulse sequence CL is in synchronism with the message signal M. The particular pulse sequence FD has a higher repetition frequency than the clock pulse sequence CL. The interruption port 54 is operable in response to the coincidence pulse DET and an enable signal S1. The particular pulse sequence FD and the enable signal S1 are used in the message processor 35 in the known manner.

The message processor 35 is coupled to the decoder 31 through first and second output ports 56 and 57 for delivering, to the decoder 31, first and second output signals ME and AC which are used in the manner described in the above-referenced patent application and which will not be therefore described any longer.

Fourth and fifth input ports 59 and 60 are coupled to the receiver switch 27 and the multifunctional switch 40, respectively.

The message processor 35 further comprises an input/output port 68 connected to the input/output bus line I/O and third, fourth, fifth, sixth, and seventh output ports 63, 64, 65, 66, and 67 connected to the chip enable line $\overline{CE}$, an address bus line AD, a write indication line $\overline{WE}$, a chip selection line $\overline{CS}$, and a command/data indication line C/$\overline{D}$, respectively. The chip enable line $\overline{CE}$, the address bus line AD, the write indication line $\overline{WE}$, and the input/output bus line I/O are coupled to the external RAM 38 (FIG. 1). On the other hand, the chip selection line $\overline{CS}$ and the command/data indication line C/$\overline{D}$ are coupled to the display driver 42 (FIG. 1).

A processor interface 69 is coupled to the display driver 42 (FIG. 1) through first and second output signal line SOUT and $\overline{SCK}$. The above-mentioned elements, such as the ports and the interface, are coupled to an internal bus 70 of the message processor 35.

The illustrated message processor 35 further comprises a control memory 75, an instruction decoder 77, a program counter 79, an arithmetic and logic unit (ALU) 81, an accumulator (ACC) 83, an internal RAM 85, and a system clock generator 87, which are all similar to those of a conventional message processor.

However, it is to be noted that the illustrated message processor 35 is put into operation in cooperation with the receiver switch 27 and the multifunctional switch 40. For this purpose, the illustrated control memory 75 includes first and second parts 91 and 92 for storing first and second specific programs or accessing the external RAM 38 to put the message processor 35 into first and second specific modes to be described later, respectively. The control memory 75 further comprises a third part 93 for storing display information signals to be described later, a fourth part 94 for storing an original datum of two bytes consisting of "10101010" and "01010101", a fifth part 95 for storing the flag, and a sixth part 96 for storing an announcement signal to be also described later. As will later be described, the original datum is written in the specific datum area as the specific datum.

Even if the message processor 35 is once deactivated and then activated by the main electric power, the content of the control memory 75 is kept as it is without being erased. This is because the control memory 75 is formed by an ROM (read only memory).

Description will proceed to operation of the message processor 35 illustrated in FIG. 4. The message processor 35 is enabled when the detection pulse DET is supplied to the interruption port 54 as a result of detection of the call number signal. In this event, the clock pulse sequence CL is supplied from the decoder 31 to the second input port 52. The message signal M is supplied through the third input port 53 and the internal bus 70 to the accumulator 83 in synchronism with the clock pulse sequence CL and thence stored in the internal RAM 85. The message signal M stored in the internal RAM 85 is decoded into a decoded message signal of 31 bits by the use of the arithmetic and logic unit 81 under control of a normal program which is stored in the control memory 75 and which is executed by the instruction decoder 77. The decoded message signal of 31 bits has an information bit signal of 20 bits and a check bit signal of 10 bits as mentioned in conjunction with FIG. 2.

The information bit signal represents the message and is memorized in the external RAM 38 (FIGS. 1 and 5) through the input/output port 68 and the input/output bus line I/O. More particularly, the external RAM 38 is put into an enabled state by rendering the chip enable line $\overline{CE}$ into a logic "0" level. The logic "0" level on the chip enable line $\overline{CE}$ may be called a chip enable signal. An address of the external RAM 38 should be specified so as to store the information bit signal. To this end, an address signal which specifies the address to be stored, is sent through the fourth output port 64 and the address bus line AD to the external RAM 38. Simultaneously, the write indication line $\overline{WE}$ is supplied with a logic "0" level from the message processor 35. The logic "0" level on the write indication line $\overline{WE}$ may be called a write indication signal.

Figure 5:
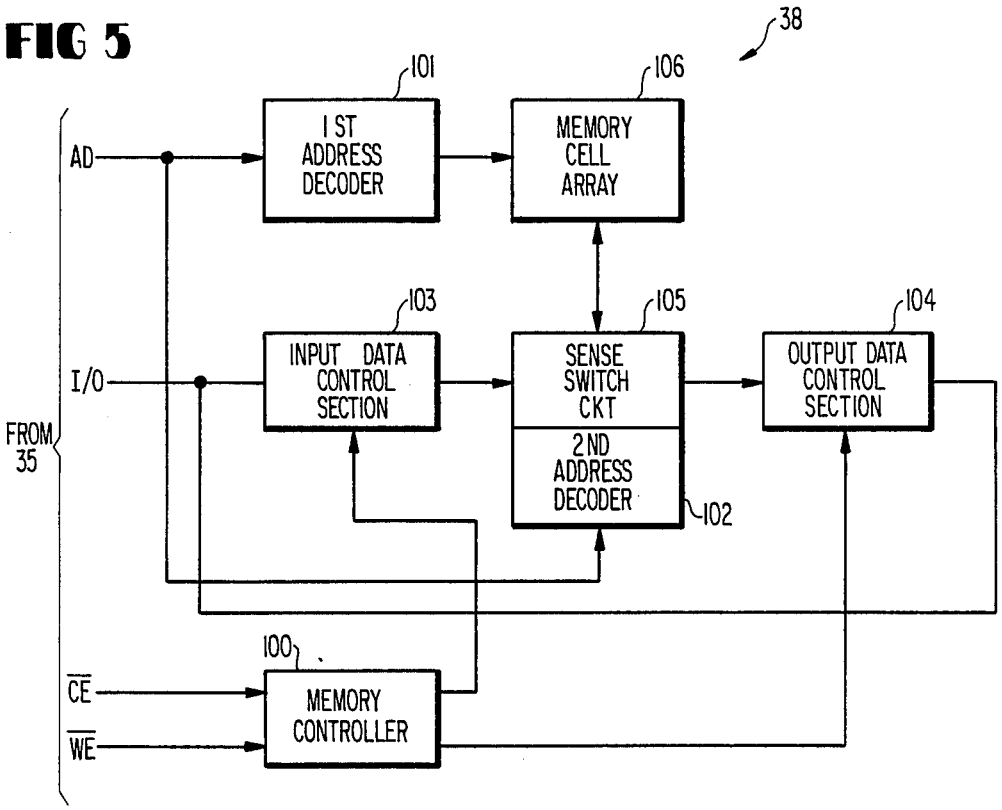
FIG. 5 is a block diagram of the external RAM mentioned in conjunction with FIG. 3.

Referring to FIG. 5, the chip enable line $\overline{CE}$ and the write indication line $\overline{WE}$ are connected to a memory controller 100 of the external RAM 38. The address bus line AD is connected to first and second address decoders 101 and 102. A combination of the first and the second address decoders 101 and 102 is operable as an X-Y decoder known in the art. The input/output bus line I/O is connected to an input data control section 103 and an output data control section 104.

Responsive to the chip enable signal and the write indication signal, the memory controller 100 controls to make the input data control section 103 deliver the information bit signal to a sense switch circuit 105. The sense switch circuit 105 writes the information bit signal in that address of a memory cell array 106 which is indicated by the first and the second address decoder 101 and 102. More particularly, the information bit signal is written in the message area MD (FIG. 3) of the memory cell array 106 as the message.

Thus, the message processor 35 is activated by the main electric power concurrently with activation of the external RAM 38 to process the message signal M into the messages and to store the messages in the message area MD (FIG. 3).

Likewise, the storage address of the message is written in the file administration information area MH (FIG. 3) by giving the logic "0" level to each of the chip enable line $\overline{CE}$ and the write indication line $\overline{WE}$. In this event, the storage address is delivered to the memory cell array 106 through the input/output bus line I/O. On the other hand, an address signal which specifies an address of the file administration information area is delivered to the memory cell array 106 through the address bus line AD.

Each of the messages stored in the memory cell array 106 is read out of the memory cell array 106 when the chip enable line $\overline{CE}$ is given a logic "0" level and the write indication line $\overline{WE}$ is given a logic "1" level. In this case, the memory controller 100 controls the output data control section 104 for delivery of each message read out of the memory cell array 106 by the sense switch circuit 105 to the input/output bus line I/O. At this time, an address signal is given to the address bus line AD to specify each message.

Likewise, each of the storage addresses, flags, and the specific datum stored in the memory cell array 106 is read out of the memory cell array 106 by giving the logic "0" level to the chip enable line $\overline{CE}$ and by giving the logic "1" level to the write indication line $\overline{WE}$.

When each of the chip enable line $\overline{CE}$ and the write indication line $\overline{WE}$ is given a logic "1" level, the memory controller 100 controls the input and the output data control sections 103 and 104 for prohibition of delivery of data from the input/output bus line I/O to the sense switch circuit 105 and for prohibition of delivery of data from the sense switch circuit 105 to the input/output bus line I/O. Thus, each of the data stored in the memory cell array 106 is kept as it is when the logic "1" level is given to both the chip enable line $\overline{CE}$ and the write indication line $\overline{WE}$.

After the information bit signals are successively stored in the external RAM 38 in the above-mentioned manner, the message processor 35 controls the display unit 41 through the display driver 42 (FIGS. 1 and 6) so as to visually display the message carried by the message signal M.

For this purpose, an initial address signal is sent from the fourth output port 64 through the address bus line AD to the external RAM 38 to specify an initial one of the addresses assigned to an initial one of the information bit signals.

Simultaneously, the chip enable line $\overline{CE}$ and the chip selection line $\overline{CS}$ are supplied from the message processor 35 with the logic "0" levels to energize the external RAM 38 and the display driver 42, respectively. The message processor 35 puts the logic "1" level on the write indication line $\overline{WE}$. Consequently, the initial information bit signal is read out of the initial address of the memory cell array 106 and is sent to the message processor 35 through the sense switch circuit 105, the output data control section 104, and the input/output bus line I/O. The internal RAM 85 temporarily stores the readout initial information bit signal. The remaining information bit signals are transferred from the external RAM 38 to the internal RAM 85 in the above-described manner.

Subsequently, the message processor 35 puts the external RAM 38 into a disabled state by turning the chip enable line $\overline{CE}$ to the logic "1" level. Simultaneously, the command/data indication line $C/\overline{D}$ is supplied with the logic "1" level so as to indicate supply of commands, such as a write-in command, a conversion command, and the like. The conversion command is for converting each information bit signal to a corresponding character. The chip selection line $\overline{CS}$ is kept at the logic "0" level to access the display driver 42. Under the circumstances, the message processor 35 supplies the display driver 42 with the commands through the first output signal line SOUT.

Thereafter, each of the information bit signals is sent from the internal RAM 85 to the display driver 42 through the first output signal line SOUT. In this case, the command/data line $C/\overline{D}$ is kept at the logic "0" level.

Figure 6:
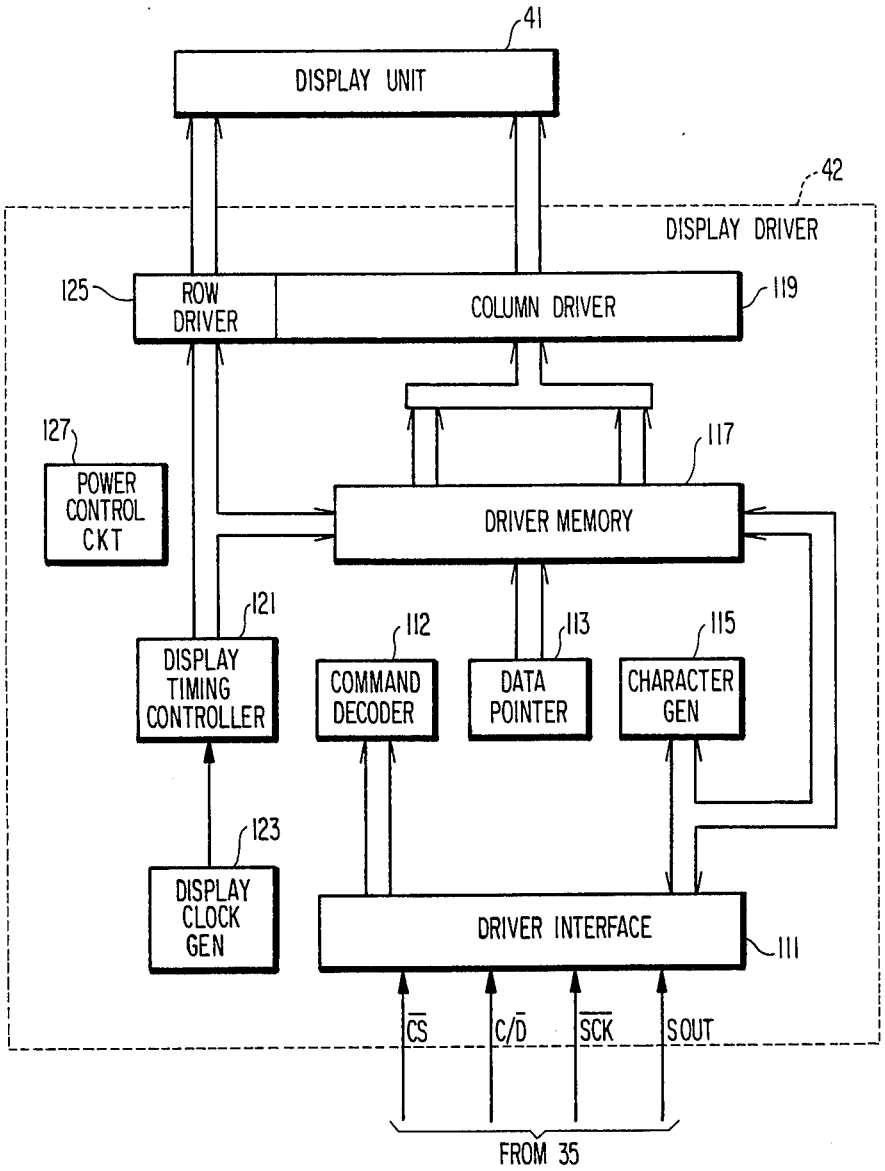
FIG. 6 shows in blocks a display driver of the pager receiver illustrated in FIG. 1 together with a display unit.

Referring to FIG. 6, the display driver 42 comprises a driver interface 111 connected to the chip selection line $\overline{CS}$, the command/data indication line $C/\overline{D}$, and the first and the second output signal lines SOUT and $\overline{SCK}$. Each command is specified by the logic "1" level supplied through the command/data indication line $C/\overline{D}$ and is delivered from the driver interface 111 to a command decoder 112. The command decoder 112 delivers driver control signals to elements of the display driver 42 determined by each command. When the command given to the display driver 42 is either the write-in command or the conversion command, a data pointer 113 is driven by the command decoder 112 to specify a memory address in a usual manner. The command/data indication line $C/\overline{D}$ is supplied with the logic "0" level after the data pointer 113 is driven.

Under the circumstances, the information bit signal is delivered through the driver interface 111 to a character generator 115. The information bit signal is converted by the character generator 115 into the corresponding character signal. The character signal may be representative of a pattern of seven-by-five dots and is stored in the memory address of a driver memory 117 which is specified by the data pointer 113.

The driver memory 117 is coupled to a column driver 119 and to a display timing controller 121 driven by a display clock generator 123. The display clock generator 123 is also used to deliver system clocks to various parts of the display driver 42. The display timing controller 121 is coupled to a row driver 125. The column and the row drivers 119 and 125 are coupled to the display unit 41 to provide visual displays. A power control circuit 127 supplies a display voltage to the parts of the display driver 42.

Each character signal is successively read out of the driver memory 117 under control of the display timing controller 121 and is displayed as each message on the display unit 41.

Figure 7:
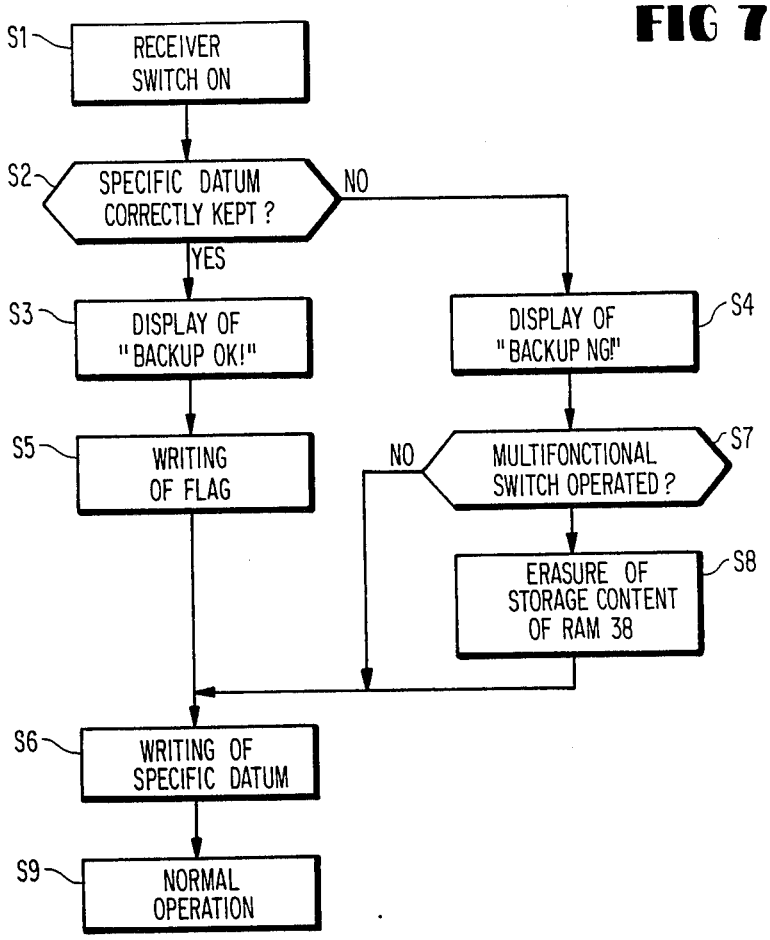
FIG. 7 is a flow chart for use in describing operation of the pager receiver illustrated in FIG. 1.

Referring to FIG. 7 afresh and FIG. 4 again, description will be made as regards operation of the message processor 35 in the first specific mode. It will be assumed that the specific datum of two bytes is already stored in the specific datum area BF (FIG. 3) of the external RAM 38 by the message processor 35 and that the external RAM 38 is backed up by the backup electric power without being activated by the main electric power. That is, the receiver switch 27 is kept in the off state.

When the receiver switch 27 is put into the on state at a first stage S1, the message processor 35 and the external RAM 38 are activated by the main electric power. Simultaneously, the message processor 35 is supplied with a first specific mode signal from the receiver switch 27 at the fourth input port 59. Responsive to the first specific mode signal, the first specific program is read out of the first part 91 of the control memory 75 by the program counter 79 and is supplied to the instruction decoder 77. The instruction decoder 77 decodes the first specific program. As a result, the message processor 35 is put into the first specific mode.

The first stage S1 proceeds to a second stage S2 at which the message processor 35 judges whether or not the specific datum of two bytes is correctly kept in the specific datum area of the external RAM 38. To this end, the specific datum is read out of the specific datum area by the message processor 35. The specific datum is supplied to the arithmetic and logic unit 81. Simultaneously, the original datum is read out of the fourth part 94 of the control memory 75. The original datum is supplied to the arithmetic and logic unit 81. Responsive to the specific datum and the original datum, the arithmetic and logic unit 81 compares the specific datum with the original datum and produces a result signal representative of a result of judgement. More specifically, the arithmetic and logic unit 81 produces a coincidence signal and a noncoincidence signal as the result signal when the specific and the original data are coincident with each other and when the specific and the original data are not coincident with each other, respectively.

In view of the foregoing, a combination of the arithmetic and logic unit 81 and the fourth part 94 serves as a judging circuit which is coupled to the specific datum area for judging whether or not the specific datum is correctly kept in the specific datum area when the external RAM 38 and the message processor 35 are activated after once deactivated. The judging circuit thereby produces the result signal. The judging circuit carries out the second stage S2.

The second stage S2 is followed by a third stage S3 when the specific and the original data are coincident with each other. Otherwise, the second stage S2 is followed by a fourth stage S4.

It is to be noted here that the display information signals stored in the third part 93 comprises a first and a second information signal. The first information signal represents the result of judgement which indicates that the specific datum is correctly kept in the specific datum area of the external RAM 38. The second information signal represents the result of judgement which indicates that the specific datum is not correctly kept in the specific datum area.

At the third stage S3, a combination of the program counter 79 and the instruction decoder 77 reads the first information signal out of the third part 93 in response to the coincidence signal. The first information signal is sent through the processor interface 69 to the display driver 42 to make the display unit 41 display the result of judgement which indicates that the specific datum is correctly kept in the specific datum area. As the result of judgement, the display unit 41 displays, such as, "BACKUP OK!".

Figure 8:
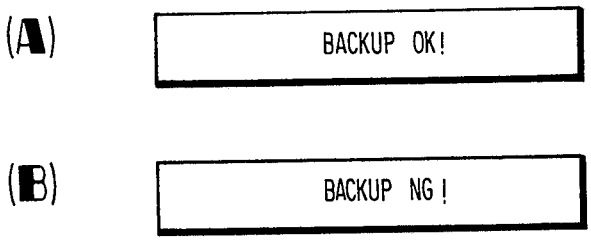
FIGS. 8(A) and 8(B) exemplify visual displays on the display unit described in connection with FIG. 6.

Temporarily referring to FIG. 8(A), illustration is made about an example of displayed information displayed on the display unit 41 at the third stage S3. That is, "BACKUP OK!" is displayed as the displayed information.

At the fourth stage S4, the combination of the program counter 79 and the instruction decoder 77 reads the second information signal out of the third part 93 in response to the noncoincidence signal. The second information signal is sent through the processor interface 69 to the display driver 42 to make the display unit 41 display the result of judgement indicative of the fact that the specific datum is not correctly kept in the specific datum area. The display unit 41 displays, such as, "BACKUP NG!" as the result of judgement.

Referring to FIG. 8(B), an example of displayed information is illustrated hhich is displayed on the display unit 41 at the fourth stage S4. "BACKUP NG!" is displayed as the displayed information. By the displayed information, the possessor can recognize that the backup power has been reduced and that it is therefore necessary to change the backup battery 24.

Thus, a combination of the program counter 79, the instruction decoder 77, and the third part 93 serves as an informing circuit responsive to the result signal for informing the result to make the display unit 41 display the result at either the third stage S3 or the fourth stage S4.

The third stage S3 is followed by a fifth stage S5 at which the message processor 35 writes the flag in the flag area of the external RAM 38 for each message which is stored in the message area and subjected to the backup operation. In this event, the instruction decoder 77 and the program counter 79 read the flag out of the fifth part 95 of the control memory 75. The flag is sent through the input/output port 68 to the external RAM 38 and is written in the flag area for each message which is stored in the memory area and is subjected to the backup operation.

As is apparent from the above, a combination of the instruction decoder 77, the program counter 79, and the fifth part 95 serves as a flag writing circuit responsive to the result signal and activated by the main electric power to write a flag in the flag area for each message which is stored in the message area and is subjected to the backup operation by the electric power when the result of judgement indicates that the specific datum is correctly kept in the specific datum area. The flag writing circuit carries out the fifth stage S5.

The fifth stage S5 proceeds to a sixth stage S6 at which the message processor 35 newly writes the specific datum in the specific datum area of the external RAM 38. In this event, the instruction decoder 77 and the program counter 79 read the original datum out of the fourth part 94 of the control memory 75. The original datum is sent through the input/output port 68 to the external RAM 38 and is newly written in the specific datum area as the specific datum.

Thus, a combination of the instruction decoder 77, the program counter 79, and the fourth part 94 serves as a specific datum writing circuit coupled to the specific datum area for writing the specific datum in the specific datum area to carry out the sixth stage S6.

The fourth stage S4 is followed by a seventh stage S7 at which the message processor 35 judges whether or not the multifunctional switch 40 is operated into an on state by the possessor of the pager receiver. The multifunctional switch 40 is also operable as an additional switch which is coupled to the informing circuit to produce an erasure mode signal after the informing circuit informs the result of judgement indicative of the fact that the specific datum is not correctly kept in the specific datum area. When the multifunctional switch 40 is operated into the on state, the erasure mode signal is supplied through the fifth input port 60 to the instruction decoder 77. The instruction decoder 77 judges the on state of the switch 40 on detection of the erasure mode signal. When the multifunctional switch 40 is put into the on state as described above, the seventh stage S7 is followed by an eighth stage S8. Otherwise, the seventh stage S7 is followed by the sixth stage S6 mentioned before.

At the eighth stage S8, the instruction decoder 77 produces an erasure instruction in response to the erasure mode signal to make the external RAM 38 erase the messages from the message area, the specific datum from the specific datum area, the flags from the flag area, and the storage addresses from the storage address area.

In view of the foregoing, the decoder 77 serves as an erasing circuit activated by the main electric power and responsive to the erasure mode signal for erasing a storage content stored in the external RAM 38 to carry out the eighth stage S8.

The eighth stage S8 is followed by the sixth stage S6 mentioned before.

The stage S6 proceeds to a ninth stage S9 at which a normal operation is carried out to wait the radio call signal under control of a normal program stored in the control memory 75.

Now, description is made as regards a case in which the specific datum of one byte is used instead of the specific datum of two bytes by referring to FIGS. 4 and 7. In such a case, it is unnecessary that the control memory 75 has the fourth part 94 for storing the original datum. Operation of the message processor 35 in the first specific mode is similar to that of the illustrated processor 35 except the second and the sixth stages S2 and S6.

At the second stage S2, the message processor 35 judges whether or not the specific datum of one byte is correctly kept in the specific datum area BF (FIG. 3) of the external RAM 38. This brings about production of the result signal representative of a result of judgement. For this purpose, the message processor 35 reads not only the specific datum of one byte out of the specific datum area but also all data out of the message area MD (FIG. 3) and the file administration information area MH (FIG. 3) at first. Subsequently, the instruction decoder 77 makes the arithmetic and logic unit 81 and the accumulator 83 add the specific datum read out of the specific datum area to all data read out of the message and the file administration information areas. The arithmetic and logic unit 81 produces a result of addition. Next, the instruction decoder 77 makes the arithmetic and logic unit 81 compare the result of addition with a one-byte datum "00000000". The arithmetic and logic unit 81 produces a coincidence signal and a noncoincidence signal as the result signal when the result of addition is coincident with the one-byte datum and when the result of addition is coincident with the one-byte datum, respectively. The coincidence signal is representative of the result of judgement which indicates that the specific datum is correctly kept in the specific datum area while the noncoincidence signal is representative of the result of judgement indicative of the fact that the specific datum is not correctly kept in the specific datum area.

Thus, a combination of the instruction decoder 77, the arithmetic and logic unit 81, and the accumulator 83 also serves as the judging circuit to carry out the second stage S2.

At the sixth stage S6, the specific datum of one byte is selected so that the one-byte datum "00000000" would result when the specific datum of one byte is added to all data stored in the message area and the file administration information area. The specific datum of one byte is newly written in the specific datum area. Such selection and writing of the specific datum is carried out by the arithmetic and logic unit 81, the accumulator 83, and the instruction decoder 77.

As is apparent from the above, the combination of the arithmetic and logic unit 81, the accumulator 83, and instruction decoder 77 also serves as the specific datum writing circuit to carry out the sixth stage S6.

Figure 9:
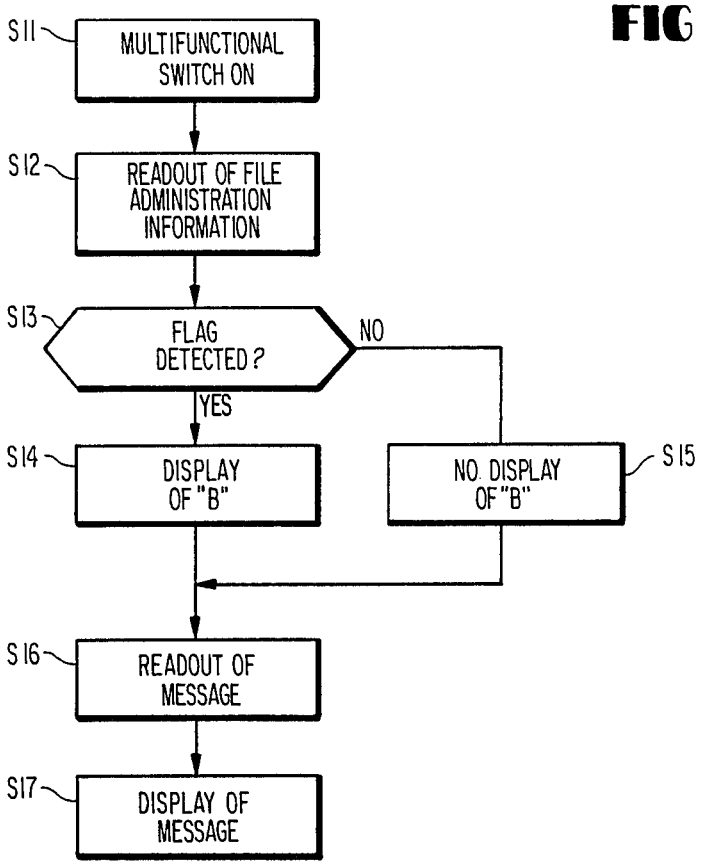
FIG. 9 is another flow chart for use in describing operation of the pager receiver illustrated in FIG. 1.

Referring to FIG. 9 afresh and FIG. 4 again, description will be made as regards operation of the message processor 35 in the second specific mode under control of the second specific program. The second specific program is for making the display unit 41 sequentially display the messages stored in the external RAM 38 together with an announcement which indicates whether or not each of the messages is subjected to the backup operation.

It will be assumed that a single message is stored in the message area MD (FIG. 3) of the external RAM 38 for brevity of description. In this case, only the file administration information for the message is stored in the file administration area MH (FIG. 3) of the external RAM 38. It will also be assumed that the multifunctional switch 40 is operated into the on state by the possessor when the call tone is not produced by the loudspeaker 36. In this case, the multifunctional switch 40 is operable as a readout switch for producing a readout mode signal.

When the multifunctional switch 40 is put into the on state at a stage S11 which will be referred to as an eleventh stage, the readout mode signal is monitored by the instruction decoder 77 through the fifth input port 60. Responsive to the readout mode signal, the instruction decoder 77 makes the control memory 75 sends the second specific program to the instruction decoder 77.

The eleventh stage S11 proceeds to a twelfth stage S12 at which the message processor 35 reads the file administration information out of the file administration information area. The file administration information read out of the file administration area is temporarily stored in the internal RAM 85.

The twelfth stage S12 is followed by a thirtenth stage S13 at which operation is made to judge whether or not the file administration information includes the flag. The judgement is carried out whether or not the flgg is detected by referring to the internal RAM 85. When the flag is detected, the thirteenth stage S13 proceeds to a fourteenth stage S14. Otherwise, the thirteenth stage S13 proceeds to a fifteenth stage S15.

At the fourteenth stage S14, a combination of the program counter 79 and the instruction decoder 77 reads the announcement signal representative of the announcement out of the sixth part 96. The announcement signal is sent through the processor interface 69 to the display driver 42 to make the display unit 41 display the announcement, such as "B".

At the fifteenth stage S15, a combination of the program counter 79 and the instruction decoder 77 does not read the announcement signal. Therefore, the announcement of "B" is not displayed on the display unit 41.

Either the fourteenth stage S14 or the fifteenth stage S15 is followed by a sixteenth stage S16 at which the message is read out of the message area with reference to the stored address of the file administration information which is temporarily stored in the internal RAM 85. That is, the message processor 35 carries out readout of the message.

The sixteenth stage S16 proceeds to a seventeenth stage S17 at which the message processor 35 controls the display driver 42 to make the display unit 41 display the message.

Figure 10:
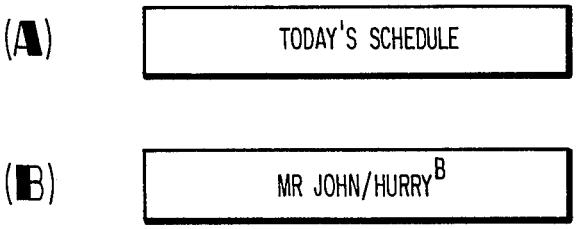
FIGS. 10(A) and 10(B) also exemplify visual displays on the display unit.

Referring to FIG. 10(A), illustration is made about an example of a displayed message which is displayed on the display unit 41 at the seventeenth stage S17. The message of "TODAY'S SCHEDULE" is displayed. Inasmuch as the announcement of "B" is not displayed, the possessor can understand that the displayed message is not subjected to the backup operation. The displayed message is newly received and stored in the external RAM 38 without being subjected to the backup operation.

Referring to FIG. 10(B), the message of "MR JOHN-/HURRY" is displayed on the display unit 41 together with the announcement of "B" at the seventeenth stage S17. Inasmuch as the announcement of "B" is displayed, the possessor can recognize that the displayed message is subjected to the backup operation.

Referring to FIGS. 4 and 9 again, a combination of the internal RAM 85, the program counter 79, the instruction decoder 77, and the sixth part 96 serves as a control circuit coupled to the display unit 41 and the flag area and activated by the main electric power for controlling the display unit 41 to make the display unit 41 display each of the messages together with the announcement with reference to the flag stored in the flag area for the each of the messages. The announcement indicates whether or not the each of the messages is subjected to the backup operation. The control circuit carries out the twelfth, the thirteenth, the fourteenth, the fifteenth, the sixteenth, and the seventeenth stages S12, S13, S14, S15, S16, and S17.

While this invention has thus far been described in conjunction with a preferred embodiment thereof, it will readily be possible for those skilled in the art to put this invention into practice in various other manners. For example, the seventh stage S7 may be omitted in FIG. 7. In this case, the fourth stage S4 proceeds to the eighth stage S8. Instead of the backup battery 24, a capacitor of a large capacitance may be used for use in accumulating the main electric power.

What is claimed is:

1. In a radio page receiver for receiving a message signal carrying messages and destined to said pager receiver, said pager receiver comprising a memory activated by main electric power and backed up by backup electric power, and having a message area and an additional area, and processing means which is activated by said main electric power to process said message signal into said messages and to store said messages in said message area and comprises writing means for writing specific datum in said additional area, judging means responsive to said specific datum for judging whether or not said message area and said additional area are correctly backed up when said memory and said processing means are activated after once deactiviated, said judging means thereby producing a result signal representative of a result of judgement, and informing means responsive to said result signal for informing said result, said page receiver further comprising a switch coupled to said informing means for producing an erasure mode signal after said informing means informs said result of judgment indicating that said message area and said additional area are not correctly backed up, and wherein said processing means further comprises erasing means activated by said main electric power and responsive to said erasure mode signal for erasing said messages and said specific datum from said message area and said additional area.

2. In a radio pager receiver for receiving a message signal carrying messages and destined to said pager receiver, said pager receiver comprising a memory activated by main electric power and backed up by backup electric power, and having a message area and an additional area, and processing means which is activated by said main electric power to process said message signal into said messages and to store said message signal into said messages and to store said messages in said message area and comprises writing means for writing a specific datum in said additional area, judging means responsive to said specific datum for judging whether or not said message area and said additional area are correctly backed up when said memory and said processing means are activated after once deactivated, said judging means thereby producing a result signal representative of a result of judgement, and informing means responsive to said result signal for informing said result, the improvement wherein:

said additional area has a first partial area for said specific datum and a second partial area;

said processing means further comprising flag writing means responsive to said result signal and activated by said main electric power to write a flag in said second partial area for each message stored in said message area and subjected to a backup operation by said backup electric power when said result of judgement indicates that said message area and said additional area are correctly backed up.

3. A radio pager receiver as claimed in claim 2, further comprising a display unit coupled to said processing means for displaying the messages stored in said message area, wherein said processing means further comprises control means coupled to said display unit and said second partial area and activated by said main electric power for controlling said display unit to make said display unit display each of said messages together with an announcement indicating whether or not said each of the messages is subjected to said backup operation with reference to the flag stored in said second partial area for said each of the messages.

4. In a radio pager receiver for receiving a message signal carrying messages and destined to said pager receiver, said pager receiver being for use in combination with a power supply circuit for generating main electric power when energized by a switch, and a backup power source for backup power source for backup electric power, and comprising a memory backed up by said backup electric power, activated by said main electric power, and having a message area and an additional area having a first and a second partial area, processing means activated by said main electric power to process said message signal into said messages and to store said messages in said message area, and a display unit coupled to the processing means for displaying the messages stored in said message area, the improvement wherein said processing means comprises:

writing means for writing a specific datum in said first partial area;

judging means responsive to said specific datum for judging whether or not said messages area and said additional area are correctly backup when said memory and said processing means are activated after once deactivated, said judging means thereby producing a result signal representative of a result of judgement;

flag writing means responsive to said result signal and activated by said main electric power to write a flag in said second partial area for each message stored in said message area and subjected to a backup oepration by said backup electric power when said result of judgement indicates that said specific datum is correctly kept in said first partial area; and control means coupled to said display unit and said second partial area and activated by said main electric power for controlling said display unit to make said display unit display each of said messages together with an announcement indicating whether or not said each of messages is subjected to said backup operation with reference to the flag stored in said second partial area for said each of the messages.

* * * * *

UNITED STATES PATENT AND TRADEMARK OFFICE
CERTIFICATE OF CORRECTION

PATENT NO. : 4,779,091

DATED : October 18, 1988

INVENTOR(S) : Tklashi OYAGI et al

It is certified that error appears in the above-identified patent and that said Letters Patent is hereby corrected as shown below:

COLUMN 14, LINE 40 Delete "thirtenth" and insert --thirteenth--.

COLUMN 14, LINE 43 Delete "flgg" and insert --flag--.

Signed and Sealed this

Thirteenth Day of June, 1989

*Attest:*

DONALD J. QUIGG

*Attesting Officer*

*Commissioner of Patents and Trademarks*